United States Patent [19]

Bridier

[11] Patent Number: 4,624,122

[45] Date of Patent: Nov. 25, 1986

[54] MACHINE FOR THE MANUFACTURE OF TUBES DEFORMED TO PROVIDE A HELICOIDAL PROFILE FOR HEAT EXCHANGERS AND SIMILAR APPLICATIONS

[75] Inventor: Robert Bridier, Culoz, France

[73] Assignee: Compagnie Industrielle d'Applications Thermiques C.I.A.T., Culoz, France

[21] Appl. No.: 782,330

[22] Filed: Oct. 1, 1985

[30] Foreign Application Priority Data

Oct. 2, 1984 [FR] France ..... 84 15263

[51] Int. Cl.[4] ..... B21D 15/04

[52] U.S. Cl. ..... 72/70; 72/78

[58] Field of Search ..... 72/70, 72, 77, 78

[56] References Cited

U.S. PATENT DOCUMENTS 2,817,363 12/1957 Penrose .
3,163,083 12/1964 Chapman et al. .
3,323,339 6/1967 Mattil .
3,379,042 4/1968 Brown, Sr. ..... 72/78
3,451,242 6/1969 Tobia ..... 72/77

FOREIGN PATENT DOCUMENTS 55042 2/1891 Fed. Rep. of Germany .
79642 2/1895 Fed. Rep. of Germany .
167874 3/1906 Fed. Rep. of Germany .
1431562 1/1966 France .

*Primary Examiner*—Lowell A. Larson
*Attorney, Agent, or Firm*—Dowell & Dowell

[57] ABSTRACT

For manufacturing tubes of the "corrugated" type, i.e. comprising at least one deformation of helicoidal profile, the smooth tube (28) is displaced axially inside a fixed sheath (7) about which rotates a sleeve (4) fixed to a head forming support for at least one radially mobile "corrugating" knurl; the displacement of the knurl is effected by a cam (25–26) which surrounds said head and which is actuated by a jack (13–14). Opposite this "corrugating" knurl there is provided a cutting knurl which cuts the tube at the end of the "corrugation" operation. The number of the "corrugating" knurls may vary.

2 Claims, 9 Drawing Figures

12
25
25a
19a
19b
19
23
26b
24
18
17a
4
17d
17c
15
15a
7
29
16
17b
21
20
17
27
30
22
28
26a
25b
26
26c

MACHINE FOR THE MANUFACTURE OF TUBES DEFORMED TO PROVIDE A HELICOIDAL PROFILE FOR HEAT EXCHANGERS AND SIMILAR APPLICATIONS

It is known that, for making heat exchangers and other apparatus of the same type, tubes of the so-called "corrugated" type have been proposed, presenting, between two connecting smooth collars, a series of deformations with helicoidal profile, obtained by rolling so as to make the inner wall like the outer wall. Studies and measurements made on this type of tube have effectively demonstrated that the pressure drops and turbulences generated by the "corrugations" in the fluid circuit improved very substantially the coefficient of heat exchange.

However, the development in the use of these tubes slowed down due to difficulties in production, the machines proposed heretofore being far from giving satisfaction in practice, and it is this drawback that the present invention intends mainly to overcome by providing a machine for manufacturing with high production rate and low maintenance cost.

It is an object of the invention to enable "corrugated" tubes of any desired length to be obtained, presenting at their ends (and even at one or more points of their length) smooth parts adapted to facilitate the operations of connection and fixation in place.

The accompanying drawing, given by way of example, will enable the invention, the characteristics that it presents and the advantages that it is capable of procuring, to be more readily understood.

Figure 1:
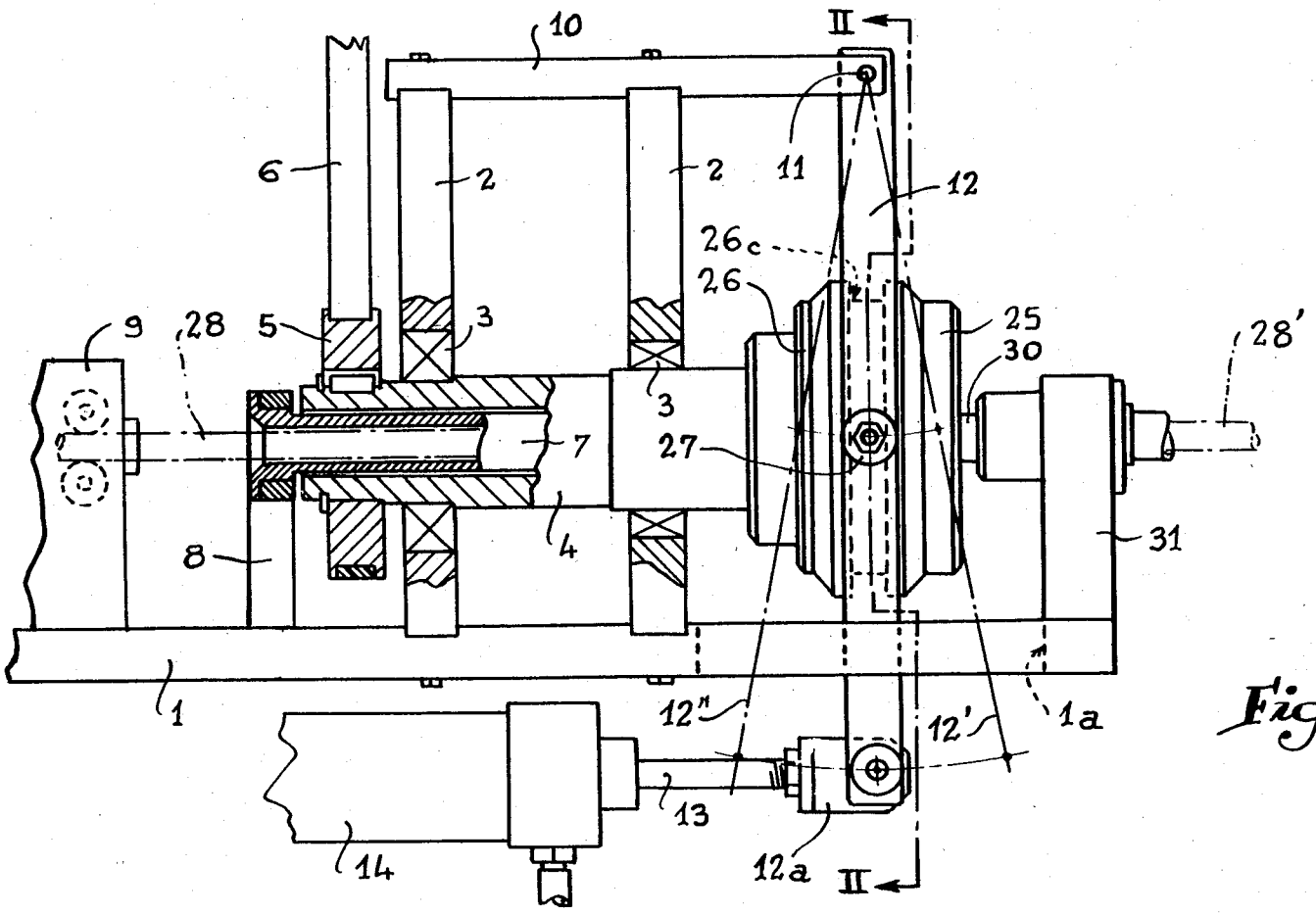
FIG. 1 is a side view with portions broken away, schematically showing the general arrangement of a "corrugating" machine according to the invention.

The fixed frame of the machine shown in FIGS. 1 to 6 is formed by a base element 1 fixed to two vertical cheeks 2 pierced horizontally to allow, with the interposition of rollers 3, the assembly of a rotating sleeve 4. In the vicinity of one of its ends, this sleeve 4 bears a driving pulley 5 which a belt 6 connects to any motor (not shown) advantageously provided to have variable speed. Inside the sleeve 4 is axially engaged a fixed sheath 7 of which the end lying level with the pulley 6 is supported by a foot 8 fixed to the base element 1; it will be observed that the opening of this sheath 7 is oriented along the axis of a device 9, of the type with rollers, intended to straighten up the tube to be worked and to feed the latter in a continuous longitudinal displacement, itself advantageously provided to have adjustable speed.

Figure 2:
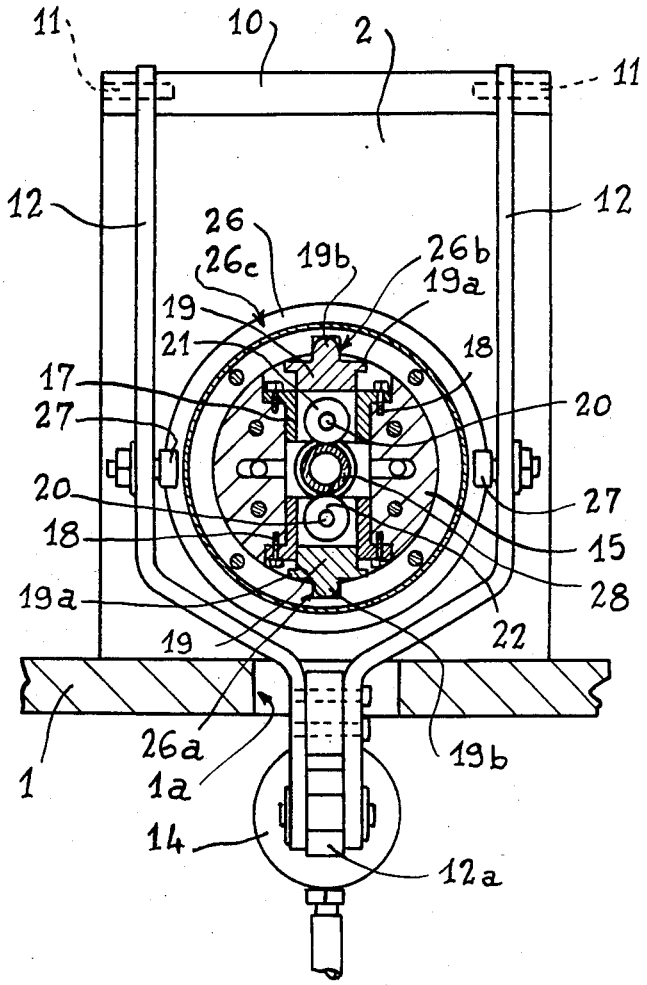
FIG. 2 is a transverse section thereof along the plane indicated at II—II in FIG. 1.

As shown more particularly in FIGS. 1 and 2, the cheeks 2 of the fixed frame 1–2 support a horizontal console 10 on the free edge of which are articulated at 11 two pivoting arms 12 of which the lower ends pass through the base element 1 through an opening 1*a* to couple with a fork-joint 12*a*. The latter is fixed at the end of the mobile member 13 of a pneumatic or hydraulic jack 14, of the double-acting type. It is apparent that, depending on whether the jack 14 is extended or retracted, it controls the arms 12 to cause them to take one or the other of the two oblique orientations indicated at 12' and 12'' in FIG. 1.

Figure 3:
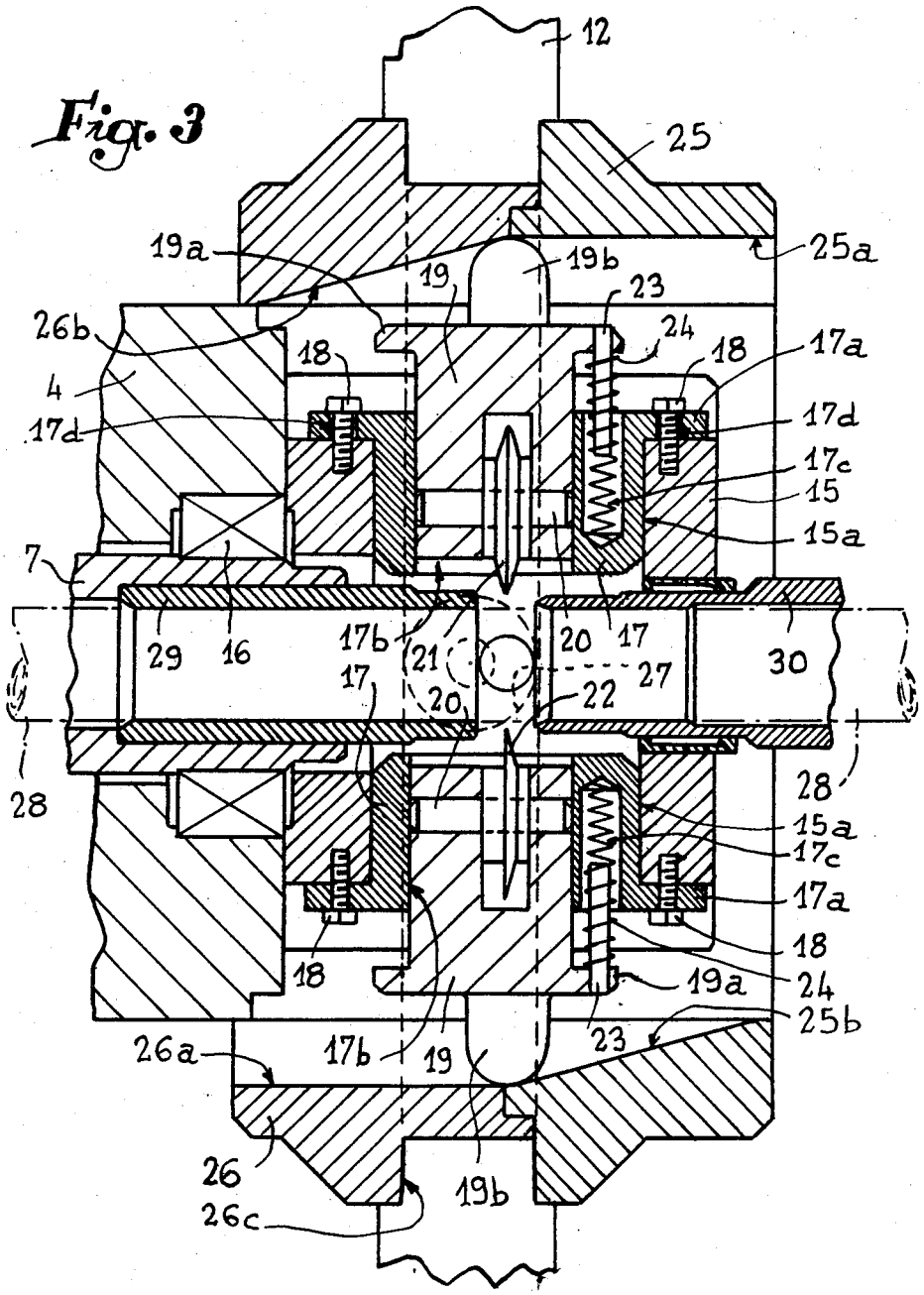
FIG. 3 is an axial section, on a larger scale, of the rotating head and the control cam.

In the manner illustrated in FIG. 3, that end of the sleeve 4 opposite the one which bears the pulley 5 is rendered fast, for example with the aid of threaded tie-rods (not shown) of a rotating head 15 disposed immediately in front of a roller bearing 16 interposed between the fixed sheath 7 and said sleeve 4. Said head 15 is pierced with two radial bores (referenced 15*a* in FIG. 4), oriented opposite one another and inside each of which is housed a cylindrical guide 17; the upper part of each guide 17 is provided with a projecting flange 17*a* fixed to the rotating head 15 with the aid of screws 18.

The opening 17*b* (FIG. 4) made axially through each guide 17 is established with a polygonal profile (rectangular in the embodiment envisaged) and inside this opening 17*b* a block 19 is slidably engaged. The latter is profiled in the manner of a downwardly open fork joint in order to bear a horizontal pin 20 forming support for a knurl referenced 21 for one of the two blocks 19, 22 for the other. Each block 19 is provided towards the top with a projecting flange 19*a* to which are fixed vertical pins 23 (of which only one has been shown in FIGS. 3 and 4) in order not to overload the drawing unnecessarily) facing downwardly; each pin 23 is engaged inside a blind bore 17*c* of the corresponding guide 17, a spring 24 tending to elastically repel the flange 19*a* and the block 19 upwardly.

Figure 4:
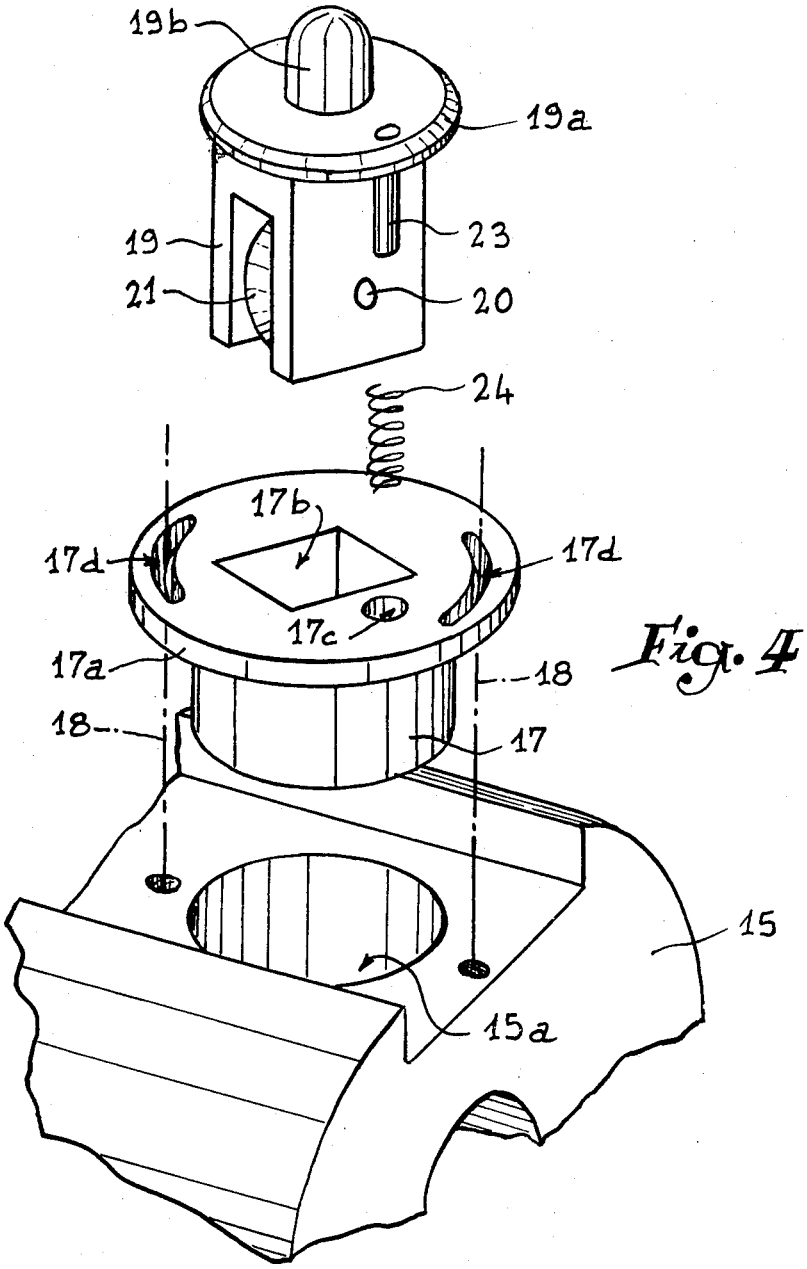
FIG. 4 illustrates in perspective, in an exploded view, the assembly of the "corrugating" knurl-holder block and its mode of adjustment.
Figure 5:
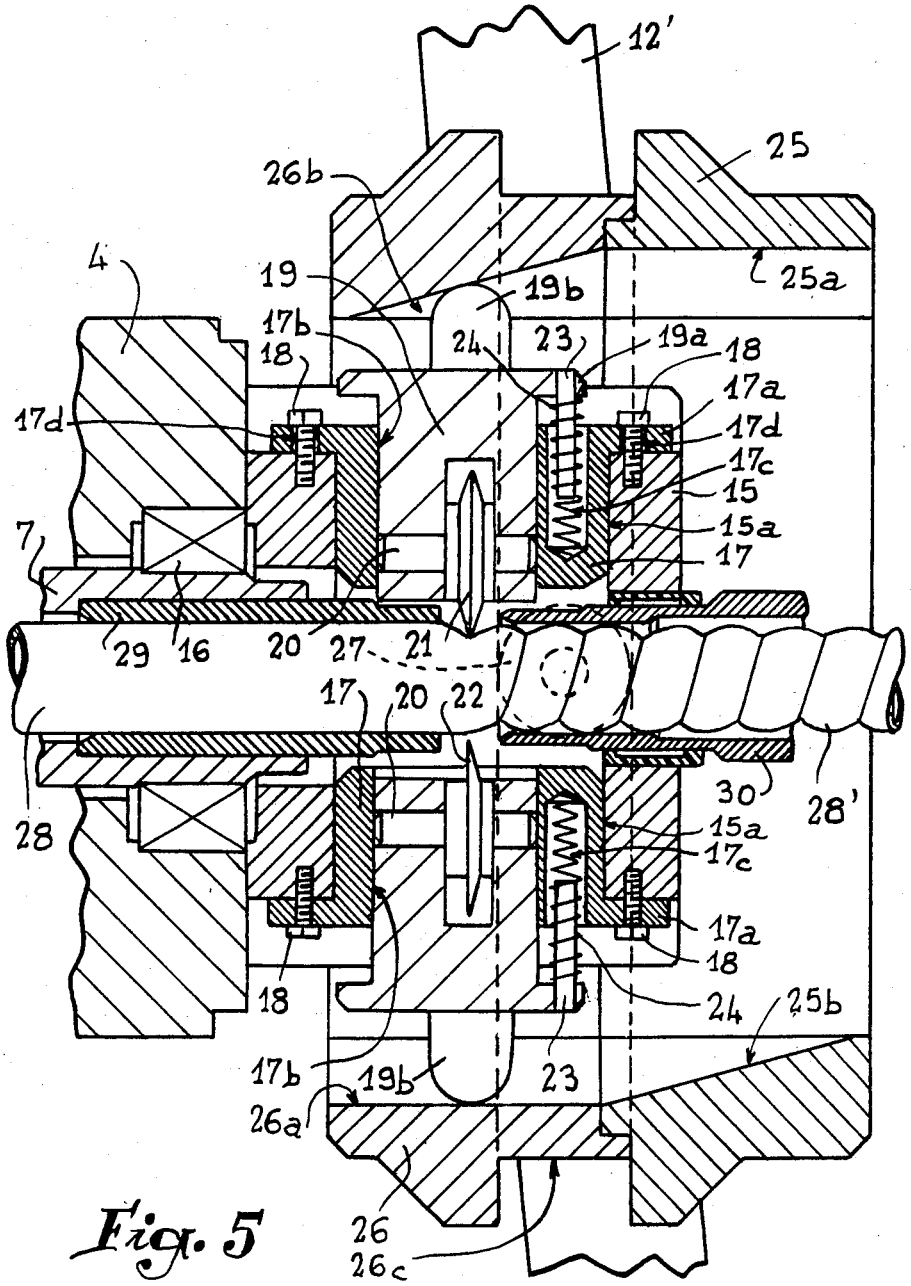
FIGS. 5 and 6 are axial sections similar to that of FIG. 3, but corresponding to two other positions.
Figure 6:
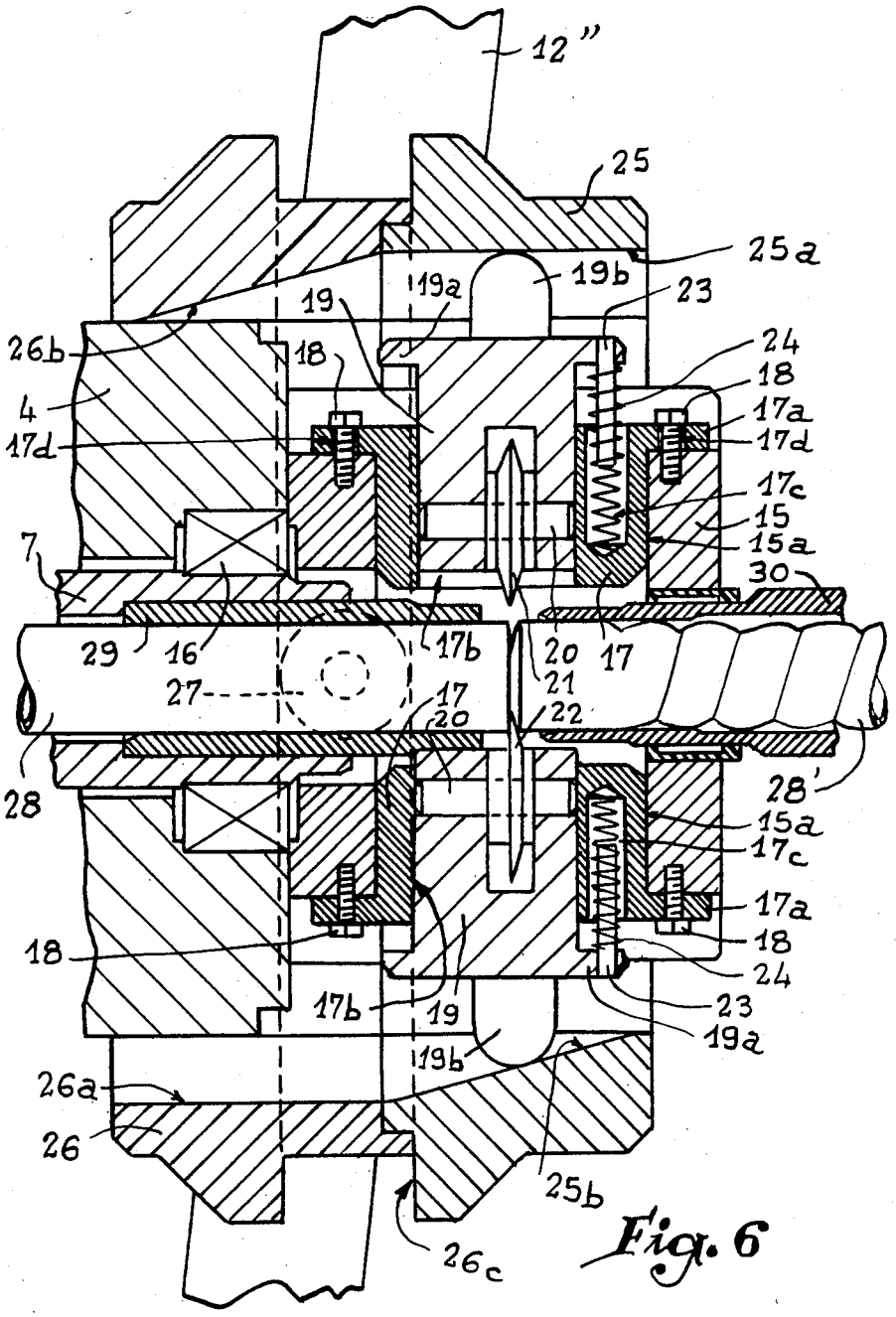

The knurl referenced 21 (disposed in the upper part of FIGS. 2 and 3) is profiled to displace the metal and it will be designated hereinafter under the name of "corrugating" knurl, whilst the knurl 22 facing downwardly in said Figures is profiled to cut the tube. It will further be observed that, although the screws 18 which ensure fixation of the guide 17 associated with the block 19 equipped with the cutting knurl 22 pass virtually without clearance through the holes made in the flange 17*a* before screwing in tappings in head 15, the same does not apply to those which retain the opposite guide forming support for the "corrugating" knurl 21; as illustrated in FIG. 4, these screws 18 are introduced into slots 17*d* with a profile in the form of an arc of circle concentric to the axis of the opening 17*b*, so as to allow adjustment of the orientation of the guide 17 envisaged and the knurl 21 with respect to the axis of the head 15.

Above its flange 19*a*, each block 19 has fixed on it a pusher or axial finger 19*b* with semi-spherical outer profile, adapted to be actuated by a cam formed by the assembly of two rings 25 and 26 which surround the rotating head 15 to which they are joined by the two fingers 19*b*. To that end, the outer wall of each of the two rings 25 and 26 is hollowed by two longitudinal grooves 25*a* and 25*b*, 26*a* and 26*b* respectively, diametrically opposite in order to receive the two fingers 19*b*, but whilst the bottom of groove 25*a*, 26*a* is oriented parallel to the axis of the cam 25–26, that of groove 25*b*–26*b* is oriented obliquely in order to form ramp for actuation of the corresponding block 19. It will further be noted that the arrangement of the four grooves or ramps indicated hereinabove is reversed, in that, once the rings are mounted in position, the obliquenesses of ramps 25*b* and 26*b* are opposite.

One of the rings 25 or 26 (ring 26 in the embodiment considered) is hollowed on its periphery with an annular depression 26*c* intended to form a track for two opposite rollers 27 (FIGS. 1 and 2) borne by the pivoting arms 12 and it will be understood that the control of the jack 14 ensures axial displacement of the cam 25–26 despite the movement of rotation which is imparted to it by the head 15.

The operation and mode of use of the machine described hereinabove follow from the foregoing explanations and are easily understood.

When the machine is set into operation, the cam 25–26 is in the mean position illustrated in FIGS. 1 and 3, in that the fingers 19*b* of the two opposite blocks 19 are engaged in the grooves 25*a* and 26*a* with straight bottom. The speed of advance imparted to the smooth tube 28 by the device 9 was adjusted as a function of the speed of rotation of the sleeve 4 and of the angle of obliqueness given to the "corrugating" knurl 21.

The smooth tube 28 penetrates axially in the fixed sheath 7 and passes through an internal end piece 29 (FIG. 3) mounted at the downstream end thereof. The end of this tube passes level with the knurls 21 and 22 and is introduced in an outlet end element 30 borne by an upright 31 (FIG. 1) fast with the sole element 1. When the length of the end of this tube which has projected beyond the transverse plane defined by the two knurls 21 and 22 corresponds to the desired length for the smooth connecting collar, the operator controls extension of the jack 14 in order to bring the pivoting arms 12 to the orientation 12' of FIG. 1; this modification of orientation has for its effect to displace the cam 25–26 which consequently affects the position illustrated in FIG. 5.

Under these conditions, the finger 19*b* of the block 19 which bears the "corrugating" knurl 21 is engaged in the ramp 26*b*, so that it is displaced radially inwardly with said block against the elastic reaction of the return springs 24. As shown, the knurl 21 comes to bear against the wall of the tube 28 which it displaces inwardly, generating thereon a helicoidal thread or "corrugation", so that said tube penetrates in the outlet end piece 30 in the "corrugated" state (reference 28').

It will be noted that the axial displacement of the cam 25–26 has, on the contrary, not affected the position of the block 19 which bears the cutting knurl 22, since the finger 19*b* of said block has remained in the groove 26*a* with straight bottom.

On the other hand, the opposite will occur when the jack 14 will again be controlled by the operator at the end of "corrugation". In fact, the retraction of this jack brings the pivoting arms 12 to the oblique position 12'' of FIG. 1, corresponding to the situation illustrated in FIG. 6. Further to the axial displacement of the cam 25–26, the block 19 which bears the knurl 21 is repelled radially outwardly by springs 24, its finger 19*b* coming into engagement in the groove 25*a* with straight bottom; the "corrugating" knurl is thus moved away from tube 28. On the other hand, the groove 25*b* with oblique bottom or ramp, by action against the finger 19*b* of the block 19 which bears the knurl 22, displaces said block radially inwardly so that this knurl 22 transversely cuts the tube during work.

Of course, the passage from position 12' (FIG. 5) to that 12'' (FIG. 6) is effected in two stages, i.e. when the length of the "corrugated" tube 28' attains the desired value, the operator controls the jack 14 to bring cam 25–26 to the mean position of FIG. 3; the action of "corrugation" ceases, but the tube 28 continues to advance. When the length desired for the smooth collar is itself obtained, the operator stops the device 9 to immobilize the tube 28 axially, and he again moves the jack 14 to ensure cutting of said tube by radial displacement of the knurl 22.

The machine is then ready to make a new length of "corrugated" tube.

Figure 7:
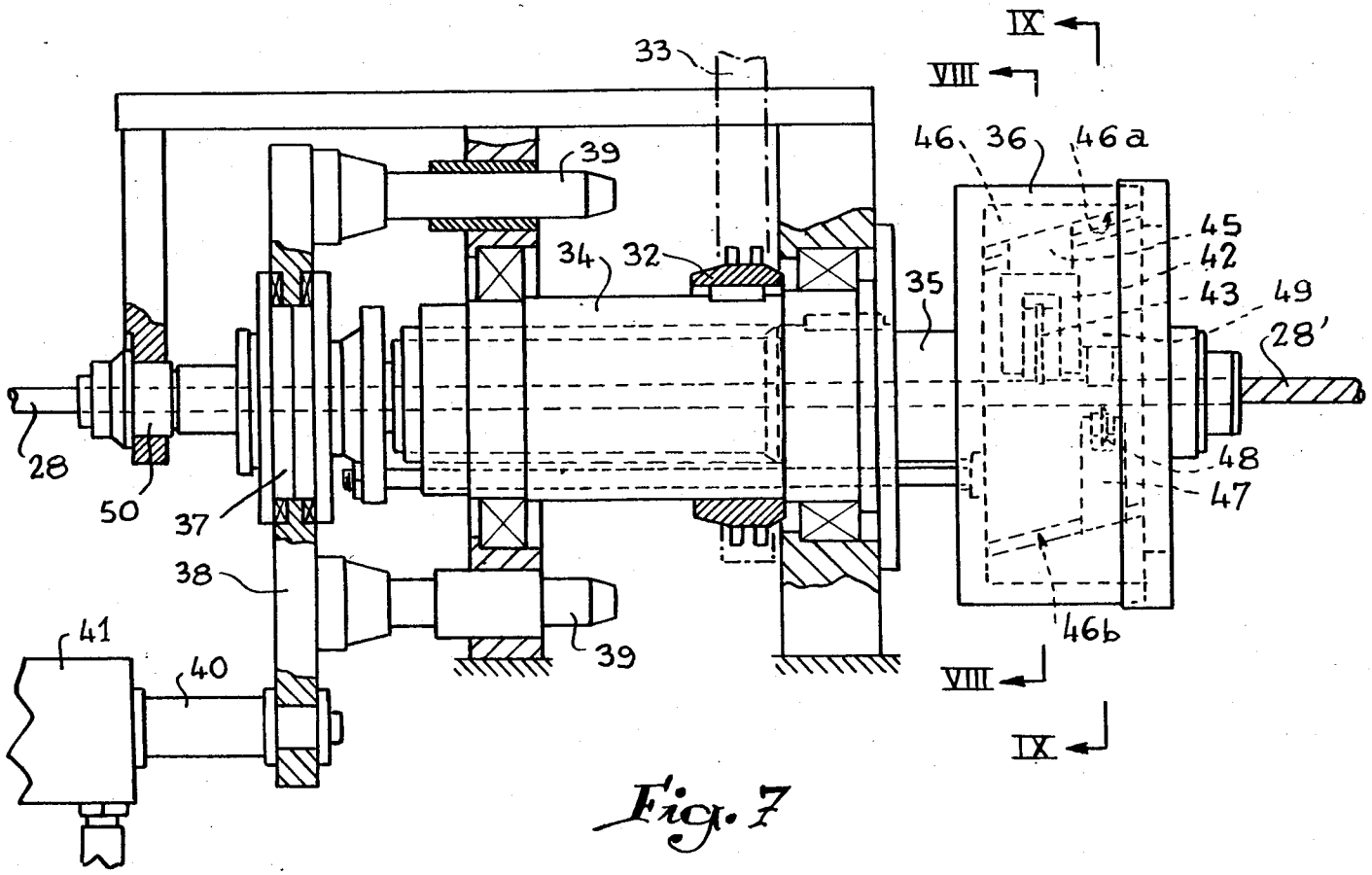
FIG. 7 is a side view similar to that of FIG. 1, showing a machine equipped with three "corrugating" knurls.
Figure 8:
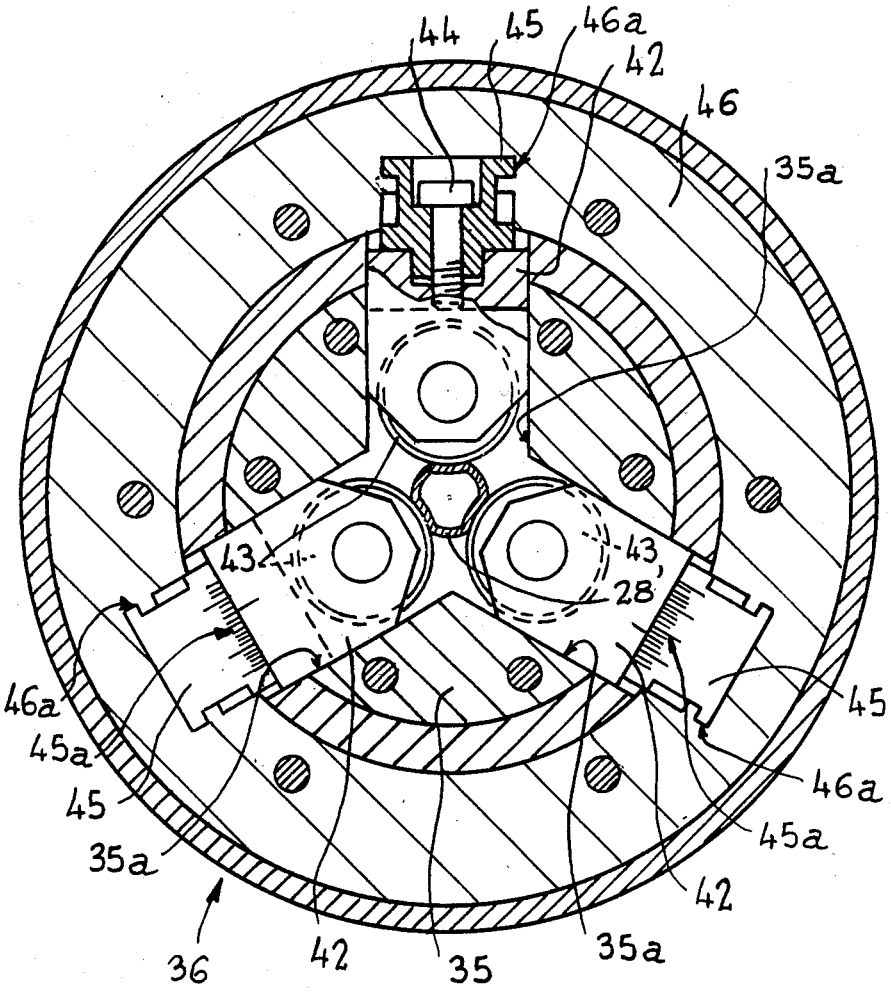
FIGS. 8 and 9 are transverse sections on a larger scale along the planes indicated at VIII—VIII and IX—IX in FIG. 7.
Figure 9:
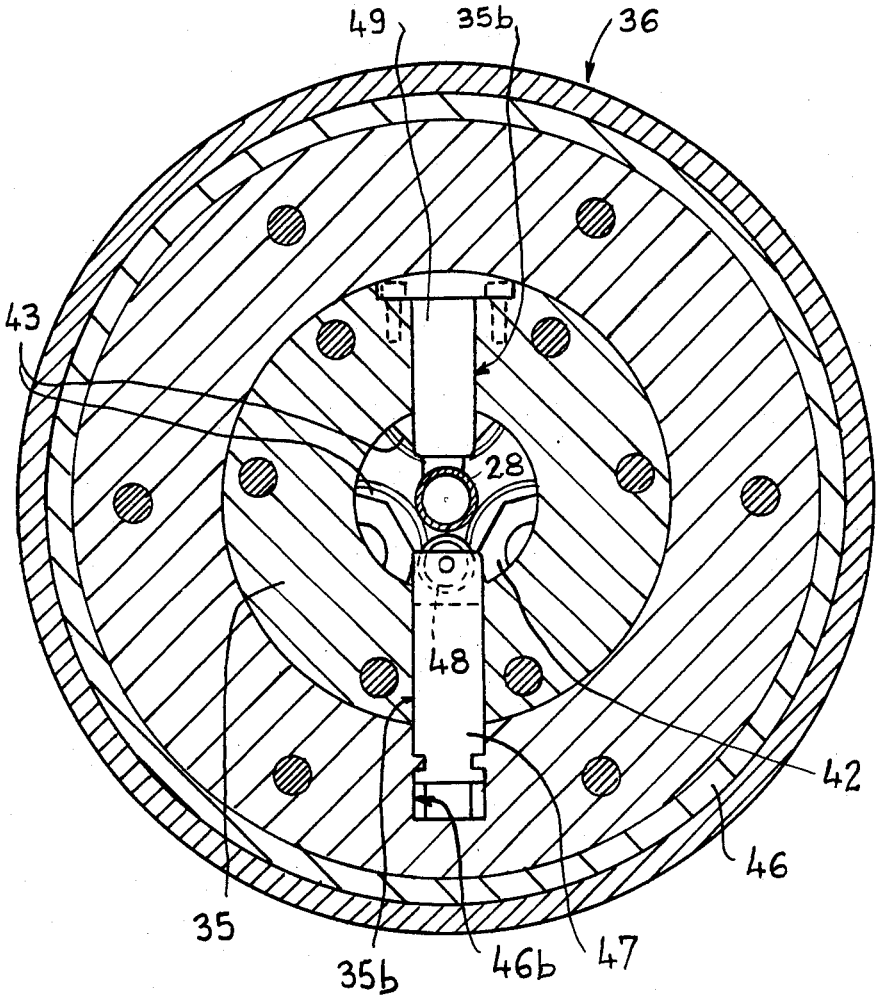

FIGS. 7 to 9 schematically illustrate the general arrangement of a "corrugating" machine with very high production rate, adapted to impart to the tube three helicoidal threads oriented at 120° with respect to one another. This machine comprises a toothed wheel 32 connected by a chain 33 to a motor with adjustable speed (not shown) and keyed on a horizontal sleeve 34 suitably supported in rotation by the general frame. Opposite the straightening and advance device (not shown in FIG. 7), this sleeve 34 is fixed to a rotating head 35 which penetrates inside an actuating cam 36 connected by longitudinal rods 37*a* to a rotary disc 37 axially connected to a transverse cheek 38; this latter, provided with lateral guides 39 which immobilize it angularly, is fixed to the mobile member 40 of a control jack 41, so that the retraction or extension of the latter modifies the position of the cam 36 with respect to the rotating head 35, as in the case of the embodiment according to FIGS. 1 to 6.

The head 35 is hollowed out with three radial bores 35*a* (FIG. 8) oriented at 120° with respect to one another and inside each of which is mounted a cylindrical block 42 forming support for a "corrugating" knurl 43. Opposite its knurl 43, each block 42 is assembled by a screw 44 on an actuating finger 45 of which the outer part is established with a dove-tail profile with a view to cooperating with a groove 46*a* with corresponding section made in one, referenced 46, of the pieces which constitute the cam 36. As illustrated in FIG. 7, the bottom of the groove 46*a* is oriented obliquely in order to act radially in the manner of a ramp on the finger 45 which is engaged.

It should be noted that adjustment of the screw 44 which assembles each block 42 on its finger 45 makes it possible to modify the orientation of said block inside its bore 35*a* and thus to adjust that of the corresponding knurl 43 with respect to the axis of the tube 28 to be "corrugated". A vernier scale 45*a* imprinted on the periphery of each finger 45 and cooperating with a mark provided on the latter, facilitates said adjustment.

Along a transverse plane offset axially on the rotating head 35 with respect to that defined by the bores 35*a* mentioned above, two cylindrical bores 35*b* (FIG. 9), diametrically opposite each other, have been made in this head. In one of these bores 35*b* is housed a block 47 of which the end facing the axis of the head 35 is equipped with a cutting knurl 48, whilst the opposite end, of dove-tail profile, is engaged in a groove 46*b* made in the piece 46 of head 35, the bottom of said groove being oriented obliquely, parallel to the bottom of each groove 46*as* as shown in FIG. 7. In the opposite bore 35*b* is mounted a support 49 rigidly fixed to piece 35.

General operation is identical to that set forth in the embodiment according to FIGS. 1 to 6. The smooth tube 28 (FIG. 7) is axially displaced continuously so as to penetrate in a fixed sheath 50 which is disposed inside the cheek 38 and the rotating sleeve 34, and penetrates in the head 35 which is supplied a continuous movement of rotation due to its connection with the said sleeve. The longitudinal displacement of the cam 36 (from left to right in FIG. 7), under the effect of the control of jack 40–41 to extend it, causes the simultaneous actuation of the three fingers 45 and the corresponding radial displacement of the blocks 42 which bear the knurls 43, so that these latter displace the wall of the tube 28 which is thus "corrugated".

The above-mentioned displacement of the cam 35 has, on the contrary, generated the radial displacement of the block 47, so that the cutting knurl 48 cannot come into contact with the tube 28'. It is only at the end of the "corrugation" operation and after maneuvre of jack 40–41 to retract it that the axial displacement of the cam 36 ensures, at the same time as the radial withdrawal of the blocks 42 which bear the corrugating knurls 43, the radial advance of the block 47 and the knurl 48, the latter consequently cutting the tube 28', naturally after the axial advance of this latter has stopped.

It will be noted that the arrangement of the machine according to the invention is particularly well suited to an entirely automatic actuation, with prior display of the length of the "corrugated" part and of the smooth end collars of each tube to be made. It will further be understood that the number of the "corrugating" knurls may vary to a very wide extent, as a function in particular of the nature of the "corrugated" tubes to be manufactured and the desired production rate. Furthermore, it will be imagined that in certain cases the radial displacement of the knurls is capable of being effected with the aid of an actuating cam with angular displacement and not rectilinear as set forth hereinabove.

The adjustment of the orientation of the "corrugating" knurls, associated with the adjustment of the speeds of advance of the tube and of rotation of the head, allows "corrugations" to be made presenting any helical angle; by angular immobilization of the head, longitudinal "corrugations" may even be made.

I claim:

1. A machine for corrugating smooth tubing to manufacture corrugated tubing for heat exhangers and the like and for cutting the corrugated tubing off to provide a desired length, comprising:

(a) head means having an axial opening therethrough;

(b) means for feeding tubing axially through said opening in the head means at a controlled rate;

(c) means for imparting relative rotation between the head means and the tubing;

(d) corrugating knurl means in said head means mounted for radial displacement inwardly to contact and corrugate the tubing and outwardly away therefrom;

(e) cutting knurl means in said head means mounted for radial displacement inwardly to contact and cut off the tubing and outwardly away therefrom; and (f) displacement means operatively associated with the head meand and the knurl means and selectively movable between a corrugation position in which it displaces only the corrugating knurl means radially inwardly and a cutting position in which it displaces only the cutting knurl means radially inwardly and a neutral position in which the knurl means are all displaced radially outwardly.

2. The machine as claimed in claim 1, wherein each corrugating and cutting knurl means comprises a block reciprocably supported in a radial bore in the head means and having an inner end and an outer end, and a knurl in the inner end of each block facing inwardly toward the tubing; and wherein the displacement means comprises cam means surrounding the head means and including multiple ramps disposed to contact the outer ends of the blocks when the cam means are displaced with respect to the head means, the ramps including corrugating ramp means disposed to contact outer ends of corrugating knurl means and drive them inwardly when the cam means is displaced from a neutral position in one axial direction and including cutting ramp means disposed to contact outer ends of cutting knurl means and drive them inwardly when the cam means is displaced from neutral position in the other axial direction, the ramps releasing said outer ends when the cam means is in neutral position.

* * * * *